US010033140B2

(12) United States Patent
Kanda et al.

(10) Patent No.: US 10,033,140 B2
(45) Date of Patent: Jul. 24, 2018

(54) CONNECTOR ATTACHABLE TO A CABLE WHICH COMPRISES A PLURALITY OF SIGNAL CABLES AND WIRE HARNESS USING THE SAME

(71) Applicant: JAPAN AVIATION ELECTRONICS INDUSTRY, LIMITED, Shibuya-ku, Tokyo (JP)

(72) Inventors: Hironori Kanda, Tokyo (JP); Junichi Miyamoto, Tokyo (JP); Masao Yamamoto, Tokyo (JP); Takashi Tokunaga, Tokyo (JP); Ryutaro Yamazaki, Toyota (JP); Hiroshi Kobayashi, Toyota (JP); Motoya Hara, Toyota (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/622,065

(22) Filed: Jun. 13, 2017

(65) Prior Publication Data

US 2018/0026401 A1 Jan. 25, 2018

(30) Foreign Application Priority Data

Jul. 21, 2016 (JP) ..... 2016-143492

(51) Int. Cl.
*H01R 12/59* (2011.01)
*H01R 13/6474* (2011.01)
(Continued)

(52) U.S. Cl.
CPC ..... *H01R 13/6474* (2013.01); *H01R 4/184* (2013.01); *H01R 9/035* (2013.01);
(Continued)

(58) Field of Classification Search
CPC ..... H01R 12/596; H01R 13/6592; H01R 13/6581; H01R 13/6593; H01R 13/514; H01R 13/502
(Continued)

(56) References Cited

U.S. PATENT DOCUMENTS 6,722,898 B2 * 4/2004 Peloza ..... H01R 13/6473 439/108
8,221,163 B2 7/2012 Kawakami et al.
(Continued)

FOREIGN PATENT DOCUMENTS

EP 2395606 A1 * 12/2011
JP 2004063360 A 2/2004
(Continued)

OTHER PUBLICATIONS

Extended European Search Report (EESR) dated Sep. 22, 2017 issued in counterpart European Application No. 17177197.5.
(Continued)

*Primary Examiner* — Abdullah Riyami
*Assistant Examiner* — Justin Kratt
(74) *Attorney, Agent, or Firm* — Holtz, Holtz & Volek PC

(57) ABSTRACT

A connector is attachable to a front end of a cable in a front-rear direction. The cable comprises coated signal cables and an outer member which protects the signal cables. The connector comprises terminals, a holding member, a shell, an assigned portion and an impedance adjusting portion. The terminals are attached to the signal cables, respectively, under an attached state where the connector is attached to the front end of the cable. The holding member holds the terminals. The shell covers the holding member to have a predetermined surface which intersects with a perpendicular direction perpendicular to the front-rear direction. The assigned portion is located on the outer member of
(Continued)

the cable under the attached state. The impedance adjusting portion is located forward of the assigned portion in the front-rear direction and located inward in the perpendicular direction in comparison with both the predetermined surface and the assigned portion.

9 Claims, 8 Drawing Sheets

(51) Int. Cl.

| | |
|---|---|
| ***H01R 4/18*** | (2006.01) |
| ***H01R 13/42*** | (2006.01) |
| ***H01R 13/6592*** | (2011.01) |
| ***H01R 9/03*** | (2006.01) |
| ***H01R 13/6473*** | (2011.01) |
| *H01R 13/514* | (2006.01) |
| *H01R 13/6593* | (2011.01) |
| *H01R 13/502* | (2006.01) |
| *H01R 13/6581* | (2011.01) |

(52) U.S. Cl.
CPC ..... *H01R 13/42* (2013.01); *H01R 13/6473* (2013.01); *H01R 13/6592* (2013.01); *H01R 12/596* (2013.01); *H01R 13/502* (2013.01); *H01R 13/514* (2013.01); *H01R 13/6581* (2013.01); *H01R 13/6593* (2013.01); *H01R 2201/26* (2013.01)

(58) Field of Classification Search
USPC ..... 439/607.5, 607.55, 607.56, 98, 634, 686
See application file for complete search history.

(56) References Cited

U.S. PATENT DOCUMENTS

| | | | | |
|---|---|---|---|---|
| 8,348,699 | B2 | 1/2013 | Nagawatari et al. | |
| 8,834,201 | B2 * | 9/2014 | Miyawaki ..... | H01R 4/184 439/585 |
| 2003/0060084 | A1 | 3/2003 | Aoki | |
| 2013/0023154 | A1 * | 1/2013 | Ii ..... | H01R 9/038 439/607.5 |
| 2013/0288522 | A1 * | 10/2013 | Ii ..... | H01R 13/59 439/607.01 |

FOREIGN PATENT DOCUMENTS

| | | | |
|---|---|---|---|
| JP | 3935878 | B2 | 6/2007 |
| JP | 2011253667 | A | 12/2011 |
| JP | 2012018898 | A | 1/2012 |
| JP | 2012160481 | A | 8/2012 |
| WO | 2016003448 | A1 | 1/2016 |

OTHER PUBLICATIONS

European Office Action dated Apr. 11, 2018 in counterpart European Application No. 17177197.5.
Extended European Search Report (EESR) dated Apr. 12, 2018 issued in European Application No. 18150593.4.

* cited by examiner

CONNECTOR ATTACHABLE TO A CABLE WHICH COMPRISES A PLURALITY OF SIGNAL CABLES AND WIRE HARNESS USING THE SAME

CROSS REFERENCE TO RELATED APPLICATIONS

This application is based on and claims priority under 35 U.S.C. § 119 to Japanese Patent Application No. JP2016-143492 filed Jul. 21, 2016, the content of which is incorporated herein in its entirety by reference.

BACKGROUND OF THE INVENTION

This invention relates to a connector attachable to a cable which comprises a plurality of signal cables.

For example, this type of connector is disclosed in JP 2012-160481A (Patent Document 1), the content of which is incorporated herein by reference.

Referring to FIG. 15, Patent Document 1 discloses a shielded connector (connector) 910 attached to a shielded twisted pair cable (cable) 950. The connector 910 comprises a plurality of inner conductive terminals (terminals) 912 and an outer conductive shell (shell) 916. The cable 950 comprises a plurality of signal cables 952 and an outer member 954 which surrounds the signal cables 952. The outer member 954 includes a shield conductor (shield) 956 and a sheath (jacket) 958. The cable 950 has an end from which the outer member 954 is removed, and the signal cables 952 have ends which are exposed outward of the outer member 954 and attached to the terminals 912 of the connector 910, respectively.

The shield 956 of the cable 950 is in contact with the shell 916 of the connector 910 so that the exposed portions, or the ends exposed outward of the outer member 954, of the signal cables 952 are electromagnetically shielded. In particular, the shell 916 is provided with a protruding portion (assigned portion) 918. The assigned portion 918 protrudes toward the outer member 954 to be placed on the shield 956 of the outer member 954 so that the electromagnetic shield is strengthened.

However, when the signal cable is exposed from the outer member of the cable, the impedance of the thus-exposed signal cable often increases because of the exposed portion. Such increase of the impedance might degrade transmission efficiency of the signal cable.

SUMMARY OF THE INVENTION

It is therefore an object of the present invention to provide a connector having a structure which facilitates to prevent the increase of the impedance of the signal cable due to the exposed portion.

An aspect of the present invention provides a connector attachable to a front end of a cable in a front-rear direction. The cable comprises coated signal cables and an outer member which protects the signal cables. The connector comprises terminals, a holding member, a shell, an assigned portion and an impedance adjusting portion. The terminals are attached to the signal cables, respectively, under an attached state where the connector is attached to the front end of the cable. The holding member holds the terminals. The shell covers the holding member and has a predetermined surface which intersects with a perpendicular direction perpendicular to the front-rear direction. The assigned portion is placed on the outer member of the cable under the attached state. The impedance adjusting portion is located forward of the assigned portion in the front-rear direction and located inward in the perpendicular direction in comparison with both the predetermined surface and the assigned portion.

Another aspect of the present invention provides a wire harness comprising a connector and a cable. The connector is attached to a front end of the cable in a front-rear direction. The cable comprises coated signal cables and an outer member. Each of the signal cables has a protected portion and an exposed portion. The outer member protects the protected portions of the signal cables. The exposed portion is located forward of the protected portion and exposed outward of the outer member. The connector comprises terminals, a holding member, a shell, an assigned portion and an impedance adjusting portion. The terminals are attached to the exposed portions of the signal cables, respectively. The holding member holds the terminals. The shell covers the holding member and has a predetermined surface which intersects with a perpendicular direction perpendicular to the front-rear direction. The assigned portion is placed on the outer member of the cable. The impedance adjusting portion is located forward of the assigned portion in the front-rear direction and is closer to the exposed portions of the signal cables in the perpendicular direction than each of the predetermined surface and the assigned portion is.

Still another aspect of the present invention provides a wire harness comprising a connector and a cable. The connector is attached to a front end of the cable in a front-rear direction. The cable comprises coated signal cables and an outer member. Each of the signal cables has a protected portion and an exposed portion. The outer member protects the protected portions of the signal cables. The exposed portion is located forward of the protected portion and exposed outward of the outer member. The connector comprises terminals, a holding member, a shell and an impedance adjusting portion. The terminals are attached to the exposed portions of the signal cables, respectively. The holding member holds the terminals. The shell covers the holding member and has a predetermined surface which intersects with a perpendicular direction perpendicular to the front-rear direction. The impedance adjusting portion is closer to the exposed portions of the signal cables in the perpendicular direction than the predetermined surface is.

According to an aspect of the present invention, the assigned portion is placed on the outer member of the cable, and the impedance adjusting portion is located forward of the assigned portion in the front-rear direction and located inward in the perpendicular direction in comparison with both the predetermined surface and the assigned portion. This structure makes the impedance adjusting portion close to the exposed portions of the signal cables of the cable so as to prevent the increase of the impedance of the signal cable due to the exposed portion.

An appreciation of the objectives of the present invention and a more complete understanding of its structure may be had by studying the following description of the preferred embodiment and by referring to the accompanying drawings.

Figure 1:
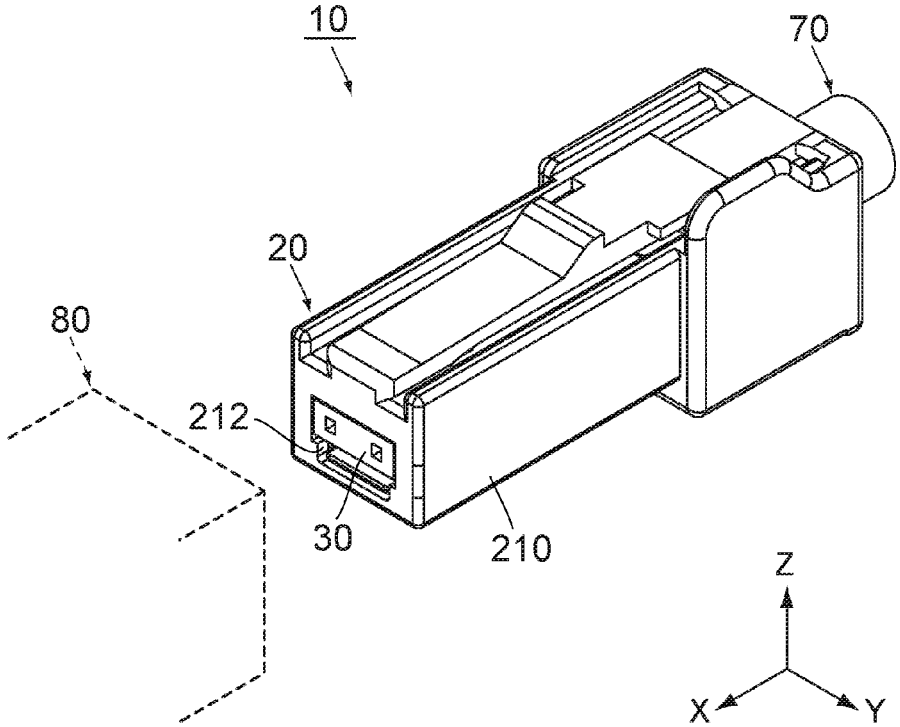
FIG. 1 is a perspective view showing a wire harness according to an embodiment of the present invention, wherein the wire harness comprises a cable and a connector mateable with a mating connector, a part of which is schematically illustrated by dashed line.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
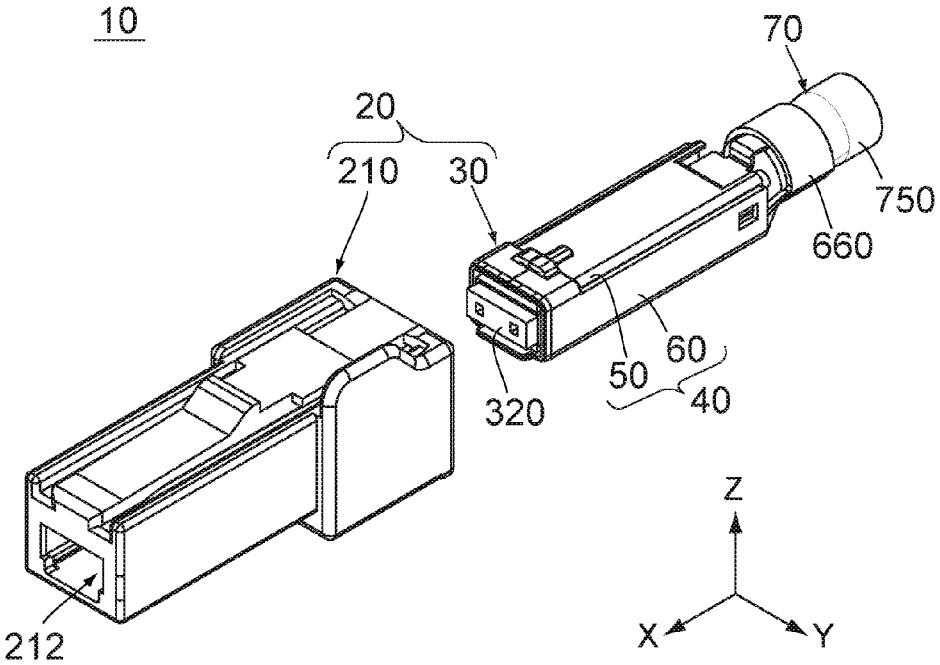
FIG. 2 is a perspective view showing the connector and the cable of FIG. 1, wherein the connector comprises an outer housing and a connector body which is attached to the cable but is not accommodated in the outer housing, and a joint of a crimp portion of a lower shell of the connector body is not illustrated.

Referring to FIGS. 1 and 2, a wire harness 10 according to an embodiment of the present invention comprises a connector 20 and a cable 70. The connector 20 comprises an outer housing 210 made of insulator and a connector body 30. The outer housing 210 is formed with an accommodation portion 212. The accommodation portion 212 is a space which passes through the outer housing 210 in the X-direction.

The connector 20 is attached to the cable 70. In detail, the connector body 30 of the connector 20 is attached to a front end 72 (see FIG. 4) of the cable 70 in a front-rear direction (X-direction). In the present embodiment, the connector body 30 is under an attached state where the connector body 30 is attached to the front end 72 (see FIG. 4) of the cable 70 and is inserted forward into the accommodation portion 212 through a rear end, or the negative X-side end, of the outer housing 210 to be accommodated within the accommodation portion 212. However, the present invention is not limited thereto. For example, the connector 20 does not need to comprise the outer housing 210. In other words, the connector 20 may consist of the connector body 30.

Referring to FIG. 1, the connector 20 is mateable with a mating connector 80 along the X-direction when the mating connector 80 is located forward, or toward the positive X-side, of the connector 20. For example, the wire harness 10, or the assembly of the connector 20 and the cable 70, according to the present embodiment is used for internal data transmission in a vehicle. In other words, the connector 20 according to the present embodiment is an in-vehicle connector. However, the present invention can be applicable to a connector other than the in-vehicle connector.

Figure 4:
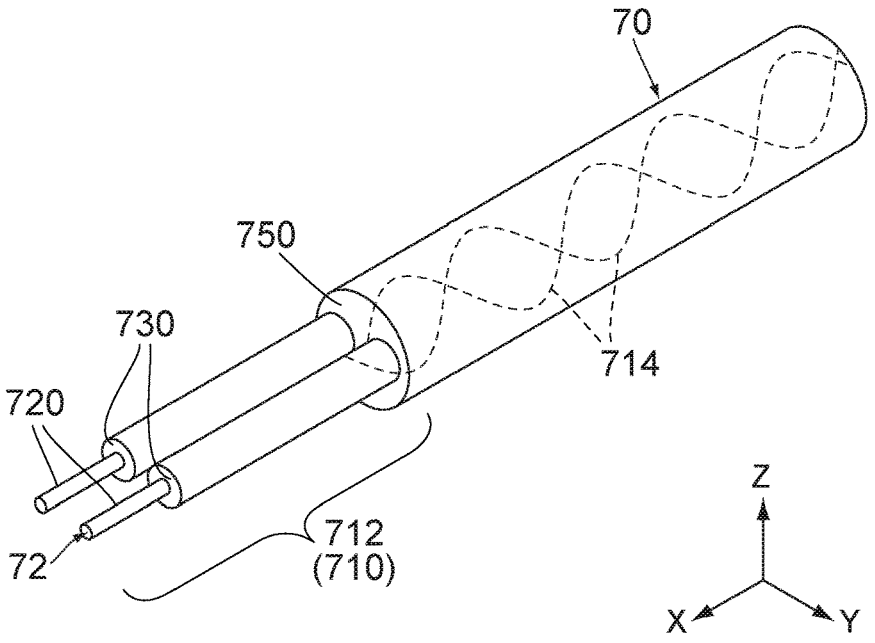
FIG. 4 is a perspective view showing the cable of FIG. 3, wherein the cable comprises an outer member and signal cables each of which has a protected portion protected by the outer member, and outlines of the protected portions are schematically illustrated by dashed line.

Referring to FIG. 4, the cable 70 is a twisted pair round cable. The cable 70 comprises two signal cables 710 which are twisted together and an outer member (jacket) 750 made of insulator. Each of the signal cables 710 is insulatively coated. More specifically, each of the signal cables 710 comprises a core wire 720 made of conductor and an insulating coating 730 made of insulator. In each of the signal cables 710, the insulating coating 730 surrounds and protects the core wire 720. The outer member 750 surrounds and protects the two signal cables 710.

The outer member 750 is removed from the vicinity of the front end 72 of the cable 70 so that each of the signal cables 710 is formed with a front end part which is exposed outward. Each of the thus-exposed signal cables 710 has an exposed portion 712, which is exposed outward of the outer member 750, and a protected portion 714 which is located within the outer member 750. The exposed portion 712 is located forward of the protected portion 714. The outer member 750 surrounds and protects the protected portions 714 of the two signal cables 710. The two protected portions 714 extend along the X-direction as a whole under the twisted state, and the two exposed portions 712 extend along the X-direction while arranged in a pitch direction (Y-direction). In each of the exposed portions 712, the insulating coating 730 is removed from the vicinity of the front end 72 of the exposed portion 712 so that the core wire 720 is formed with a front end part which is exposed outward.

As previously described, in the present embodiment, the cable 70 is a twisted pair round cable and comprises the two signal cables 710 which are twisted together. However, the present invention is not limited thereto. For example, the cable 70 does not need to be a twisted pair cable. In other words, the protected portions 714 of the two signal cables 710 may extend without twisted. Moreover, the two signal cables 710 may be surrounded by a shielding member such as a shielding tape (not shown). In this case, the outer member 750 including a shielding tape may surround and protect the two signal cables 710. Moreover, the cable 70 may comprise three or more of the signal cables 710. Thus, the cable 70 may comprise a plurality of the coated signal cables 710 and the outer member 750 which protects the plurality of the signal cables 710.

Figure 5:
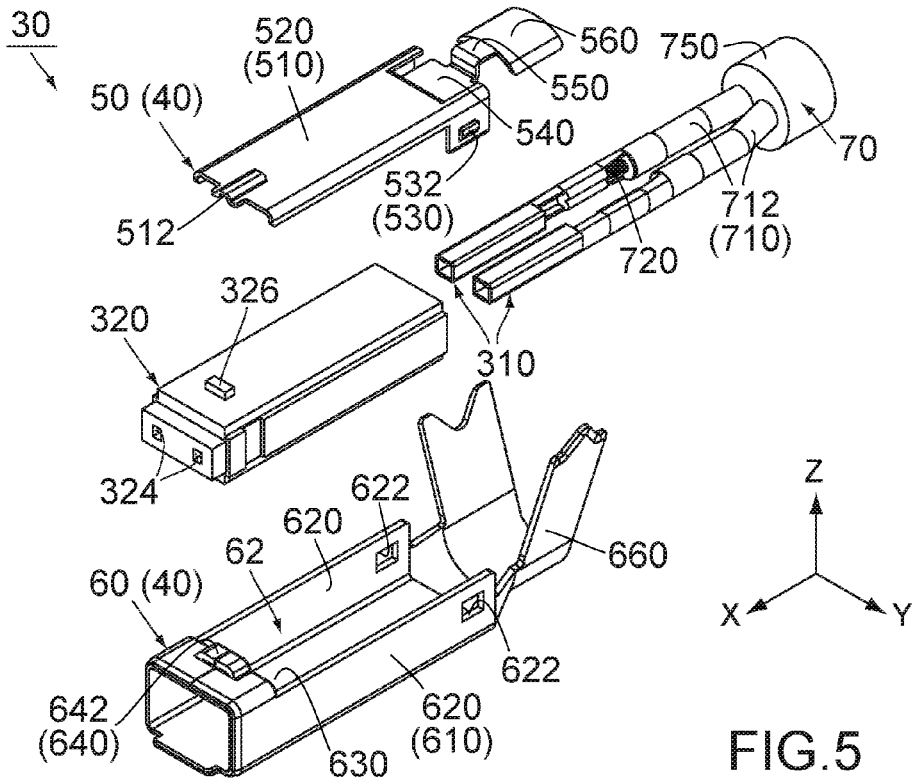
FIG. 5 is an exploded, perspective view showing the connector body of FIG. 3.

Referring to FIG. 5, the connector body 30 comprises two terminals 310 each made of conductor, a holding member 320 made of insulator and a shell 40. The shell 40 is formed of an upper shell 50 made of metal and a lower shell 60 made of metal.

Figure 9:
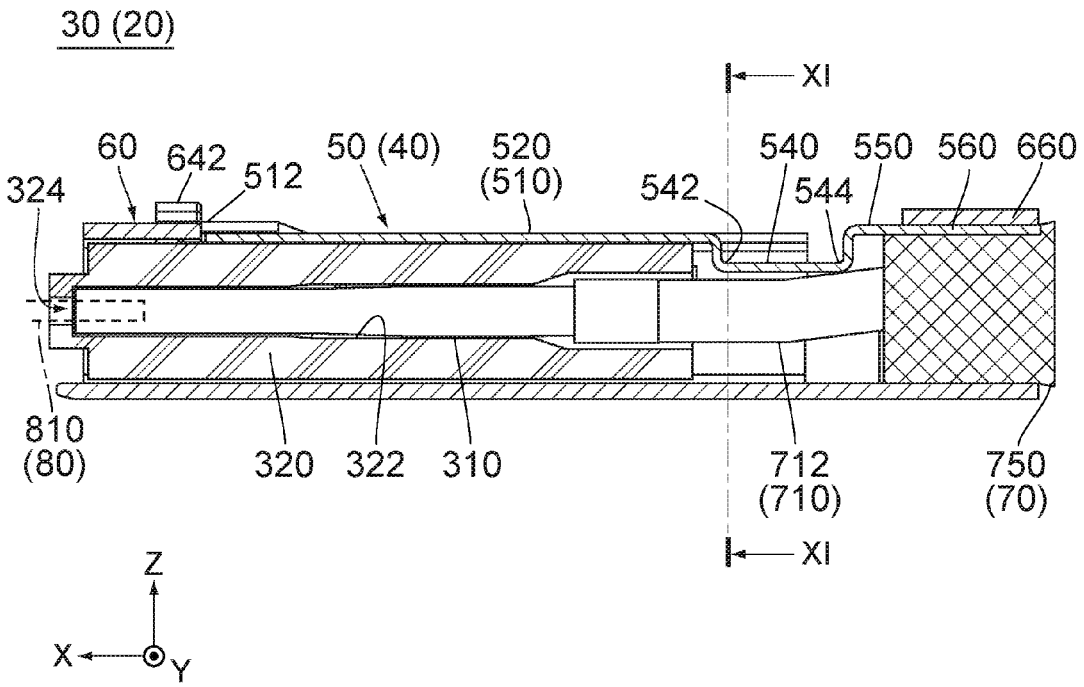
FIG. 9 is a cross-sectional view showing the connector body of FIG. 8, taken along line IX-IX, wherein a terminal of the connector body and the signal cable of the cable are illustrated by their side surfaces, and a part of a mating terminal of the mating connector is schematically illustrated by dashed line.

Referring to FIGS. 5 and 9, the terminals 310 correspond to the signal cables 710 of the cable 70, respectively. More specifically, under the attached state where the connector body 30 is attached to the front end 72 (see FIG. 4) of the cable 70, the terminals 310 are attached to the exposed portions 712 of the signal cables 710, respectively. In detail, each of the terminals 310 is connected to the core wire 720 of the corresponding signal cable 710. According to the present embodiment, since the number of the signal cables 710 is two, the number of the terminals 310 is two. However, the connector body 30 may comprise a plurality of the terminals 310 which correspond to the signal cables 710, respectively. Moreover, although each of the terminals 310 according to the present embodiment is a socket, each of the terminals 310 may be a pin.

Referring to FIG. 5, the holding member 320 roughly has a rectangular parallelepiped shape which extends long in the X-direction. As can be seen from FIGS. 5 and 9, the holding member 320 has two holding portions 322, which are arranged in the Y-direction, two connection holes 324, which correspond to the holding portions 322, respectively, and a projection 326. Each of the holding portions 322 is a space which extends within the holding member 320 along the X-direction. Each of the holding portions 322 opens forward via the corresponding connection hole 324 and opens rearward. The projection 326 is provided on an upper surface, or the positive Z-side surface, of the holding member 320 in an upper-lower direction (Z-direction: perpendicular direction) and projects upward, or in the positive Z-direction.

As can be seen from FIGS. 5 and 9, the holding member 320 holds the terminals 310. In detail, the terminals 310 are attached to the signal cables 710, respectively, and subsequently inserted into the holding portions 322, respectively, from behind the holding member 320. The terminals 310, which are inserted in the holding portions 322, are arranged in the Y-direction and held by the holding portions 322. As can be seen from FIG. 9, under a mated state where the connector 20 and the mating connector 80 are mated with each other, each of the terminals 310 is connected to a corresponding mating terminal 810 of the mating connector 80. This connection enables data transmission between a device (not shown), to which the cable 70 is attached, and a mating device (not shown) to which the mating connector 80 is attached.

Figure 6:
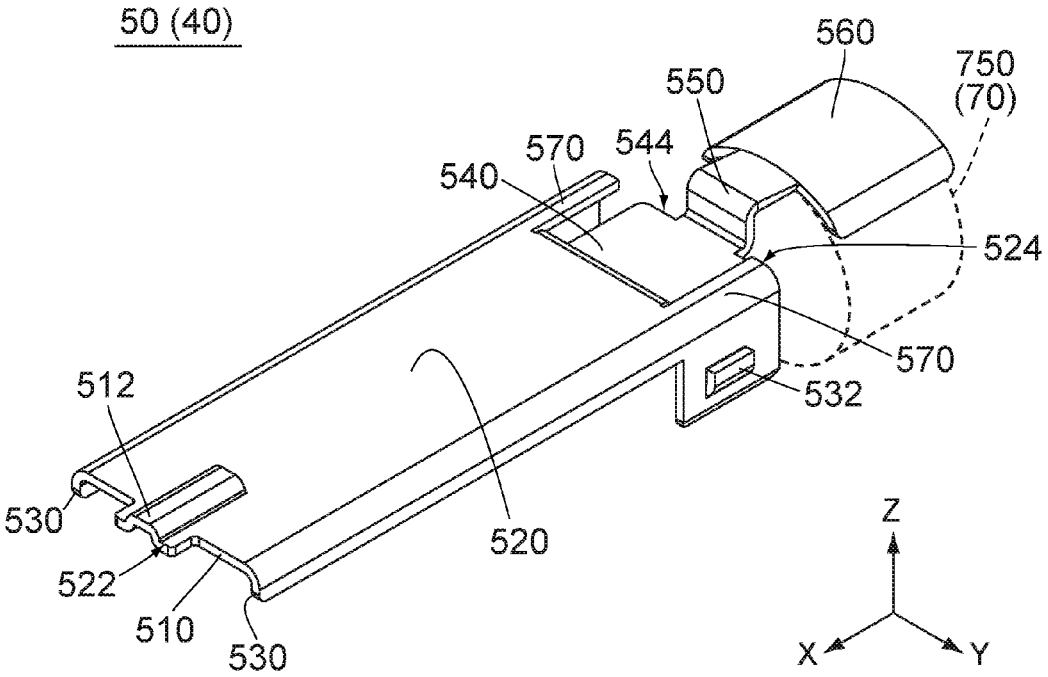
FIG. 6 is a perspective view showing an upper shell of the connector body of FIG. 5, wherein an outline of the outer member of the cable is illustrated by dashed line.

Referring to FIG. 6, the upper shell 50 is a single metal plate with bends. The upper shell 50 has various portions which are formed via bending, etc. More specifically, the upper shell 50 has an upper plate 510, two side plates 530, an impedance adjusting portion 540, a coupling portion 550 and an assigned portion 560.

The upper plate 510 has a flat-plate shape extending in the XY-plane. The side plates 530 extend downward, or in the negative Z-direction, from opposite sides of the upper plate 510 in the Y-direction, respectively. The impedance adjusting portion 540 has a flat-plate shape extending in the XY-plane to have a front end 542 (see FIG. 9) and a rear end 544 in the X-direction. The impedance adjusting portion 540 is located in the vicinity of a rear end, or the negative X-side end, of the upper plate 510 in the X-direction and located below the upper plate 510 in the Z-direction. More specifically, referring to FIG. 9, a part of a rear end part of the upper plate 510 is bent to extend downward and subsequently bent to extend rearward so that the impedance adjusting portion 540 is formed.

Referring to FIG. 6, the upper plate 510 has a projecting portion 512 and a predetermined surface 520. The predetermined surface 520 extends in the XY-plane to have a front end 522 and a rear end 524 in the X-direction. The projecting portion 512 protrudes upward from the predetermined surface 520 and partially projects forward from a front end of the upper plate 510. Each of the side plates 530 has an attachment portion 532. Each of the attachment portions 532 is provided in the vicinity of a rear end of the corresponding side plate 530 and protrudes outward in the Y-direction.

The coupling portion 550 extends upward from the rear end 544 of the impedance adjusting portion 540 and subsequently extends rearward. The assigned portion 560 is connected to a rear end of the coupling portion 550. Thus, the coupling portion 550 couples the assigned portion 560 and the impedance adjusting portion 540 to each other in the X-direction. The assigned portion 560 has a shape which corresponds to a surface of the outer member 750 of the cable 70. More specifically, the assigned portion 560 has an arc shaped cross-section in the YZ-plane, which has a curvature similar to that of a circular cross-section of the outer member 750 in the YZ-plane.

Figure 11:
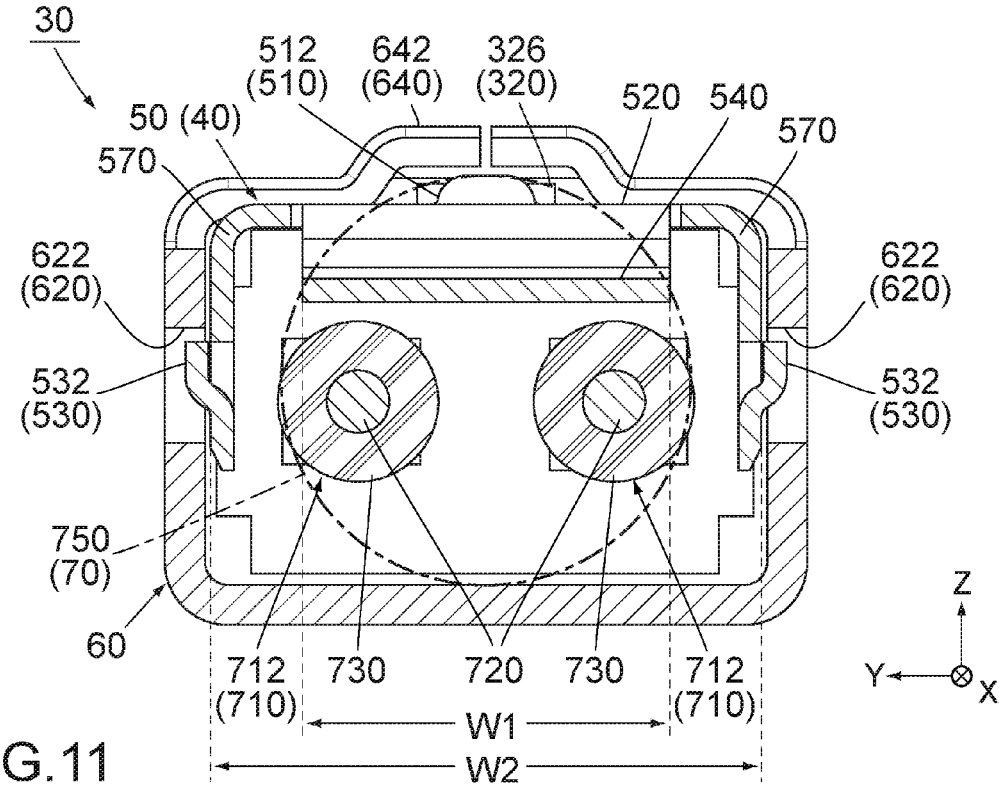
FIG. 11 is a cross-sectional view showing the connector body of FIG. 9, taken along line XI-XI, wherein an approximate position of the outer member of the cable is illustrated by chain dotted line.

Referring to FIGS. 6 and 11, the upper shell 50 is formed with two side portions 570. The side portions 570 are located at opposite sides of the impedance adjusting portion 540 in the Y-direction, respectively. Each of the side portions 570 is formed of an upper plate part, which is a part of the upper plate 510, and a side plate part which is a part of the side plate 530. In each of the side portions 570, the upper plate part protrudes inward in the Y-direction from an upper end, or the positive Z-side end, of the side plate part.

Figure 7:
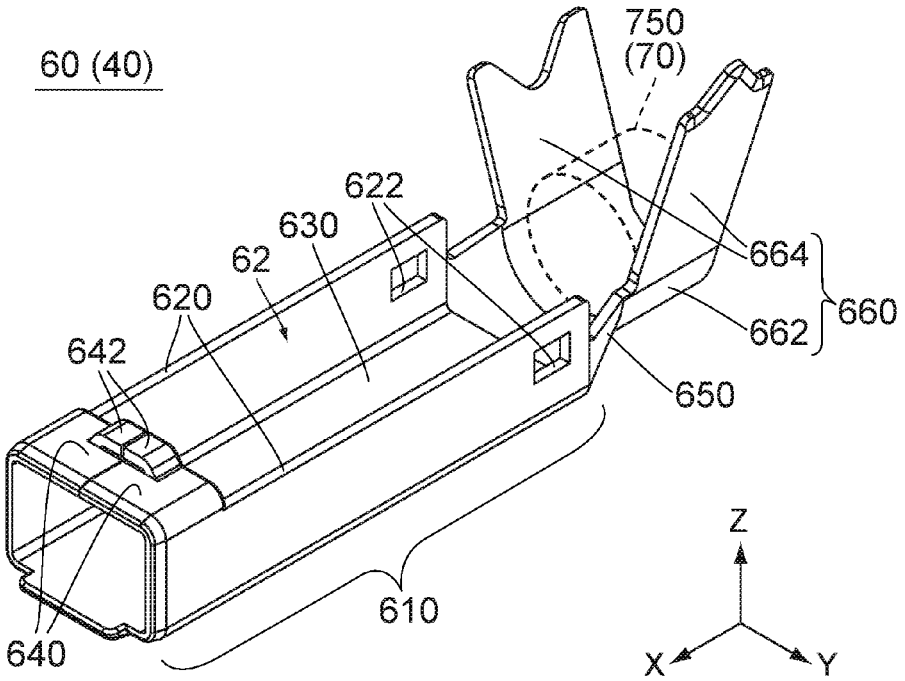
FIG. 7 is a perspective view showing the lower shell of the connector body of FIG. 5, wherein an outline of the outer member of the cable is illustrated by dashed line.

Referring to FIG. 7, the lower shell 60 is a single metal plate with bends. The lower shell 60 has various portions which are formed via bending, etc. More specifically, the lower shell 60 has a body portion 610, a connection portion 650 and a crimp portion 660.

The body portion 610 has two side plates 620, a lower plate 630 and two upper plates 640. The lower plate 630 has a flat-plate shape extending in the XY-plane. The side plates 620 extend upward from opposite sides of the lower plate 630 in the Y-direction, respectively. The thus-shaped lower shell 60 is formed with a receiving portion 62 which are surrounded by the side plates 620 and the lower plate 630. The receiving portion 62 is a channel which extends along the X-direction and opens forward and rearward. The upper plates 640 are connected to upper ends of the side plates 620, respectively, and cover a front end part of the receiving portion 62 from above.

Each of the upper plates 640 partially protrudes upward to form a protruding portion 642. The protruding portion 642 is located in the vicinity of a rear end of the upper plate 640 and protrudes upward. Each of the side plates 620 is formed with an attachment hole 622. The attachment hole 622 is a hole passing through the side plate 620 in the Y-direction and is provided in the vicinity of a rear end of the side plate 620.

The connection portion 650 extends rearward from a rear end of the body portion 610. The crimp portion 660 has a lower portion 662 and two upper portions 664. The lower portion 662 is connected to a rear end of the connection portion 650. Thus, the connection portion 650 connects the crimp portion 660 and the body portion 610 to each other in the X-direction. The lower portion 662 has a half-cylindrical shape which corresponds to the surface of the outer member 750 of the cable 70. The upper portions 664 extend upward from opposite sides of the lower portion 662 in the Y-direction.

Figure 3:
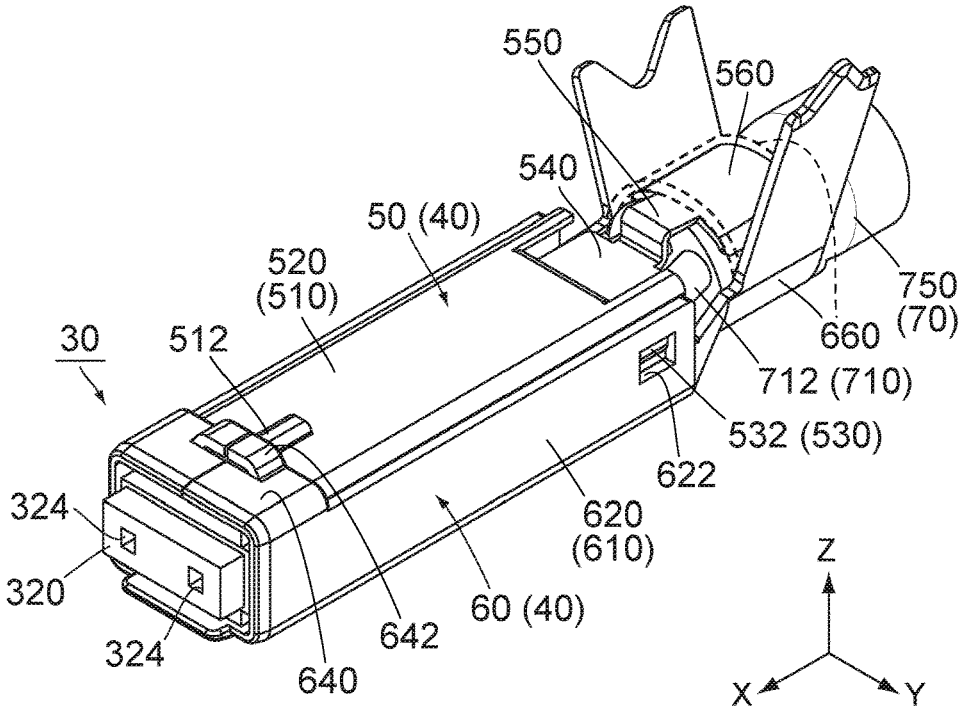
FIG. 3 is a perspective view showing the connector body and the cable of FIG. 2, wherein the crimp portion of the lower shell is not crimped, and an outline of the crimp portion under a crimped state is illustrated by dashed line.

As can be seen from FIGS. 3 and 5, the holding member 320, which holds the terminals 310, is inserted into the receiving portion 62 of the lower shell 60 while moved downward and forward to be received in the receiving portion 62. The projection 326 of the holding member 320 is located under the protruding portions 642 of the lower shell 60. The upper shell 50 is attached to the lower shell 60 after the holding member 320 is received in the receiving portion 62. The projecting portion 512 of the upper shell 50 is partially located under the protruding portions 642, and the attachment portions 532 of the upper shell 50 are attached to the attachment holes 622 of the lower shell 60, respectively.

Figure 8:
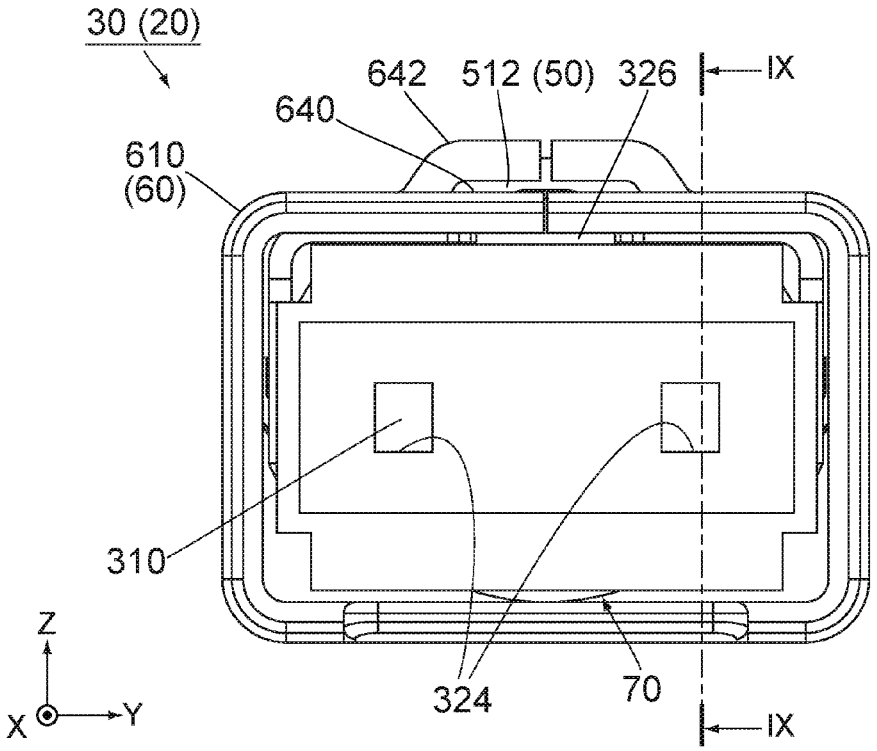
FIG. 8 is a front view showing the connector body of FIG. 2.

As can be seen from FIGS. 8 and 11, the connector body 30 is assembled as described above, so that the projection 326 of the holding member 320 is sandwiched between the upper plates 640 of the lower shell 60 and the projecting portion 512 of the upper shell 50 in the X-direction. Referring to FIG. 3, the holding member 320 is held between the upper shell 50 and the lower shell 60, and the shell 40 (the upper shell 50 and the lower shell 60) covers the holding member 320 in the YZ-plane.

As can be seen from FIGS. 2 and 3, the crimp portion 660 of the lower shell 60 is crimped on the outer member 750 of the cable 70 while the assigned portion 560 of the upper shell 50 is sandwiched between the crimp portion 660 and the outer member 750. When the crimp portion 660 is crimped on the outer member 750, the connector body 30 is under the attached state where the front end 72 (see FIG. 4) of the cable 70 is attached thereto, and a front end part of the cable 70 is fixed to the connector body 30.

Referring to FIGS. 3 and 9, under the attached state where the connector body 30 is attached to the front end 72 (see FIG. 4) of the cable 70, the assigned portion 560 of the upper shell 50 is placed on the outer member 750 of the cable 70 and fixed to the outer member 750. Therefore, the impedance adjusting portion 540 of the upper shell 50 is hardly moved relative to the exposed portions 712 of the signal cables 710 even if the cable 70 is shaken, for example. Therefore, under the attached state, the distance between the impedance adjusting portion 540 and each of the exposed portions 712 is kept constant.

In the present embodiment, the assigned portion 560 has the arc shape slightly curved in the YZ-plane and fixed only to an upper side of the outer member 750. However, the present invention is not limited thereto. For example, the assigned portion 560 may have a half-cylindrical shape. In this case, the assigned portion 560 may be placed on and fixed to opposite sides of the outer member 750 in the Y-direction in addition to the upper side of the outer member 750. Instead, the half-cylindrical shaped assigned portion 560 may be placed on and fixed to one of the opposite sides in the Y-direction, the upper side and a lower side of the outer member 750.

Figure 10:
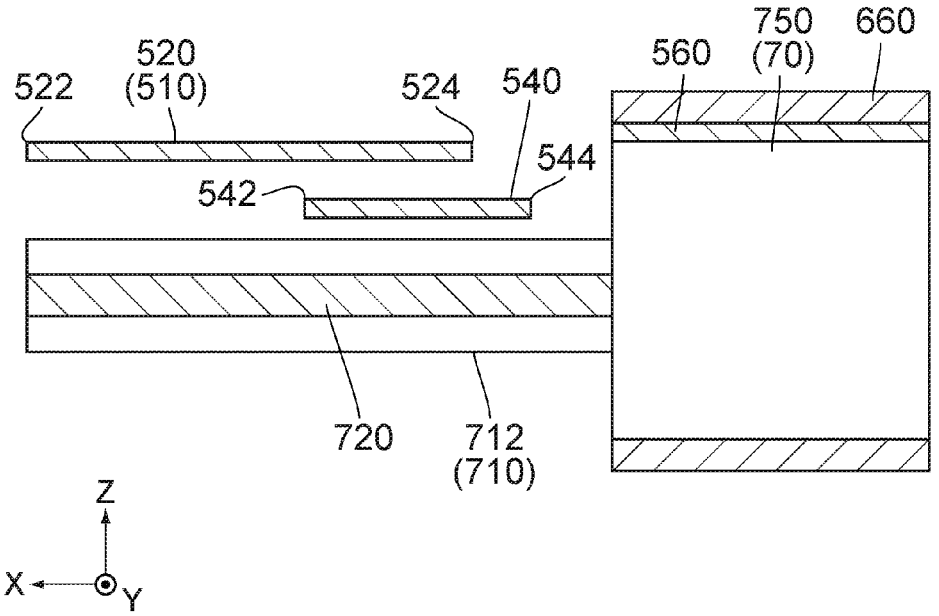
FIG. 10 is a schematic view showing a positional relation among a predetermined surface, an impedance adjusting portion and an assigned portion of the connector body of FIG. 9.

Referring to FIGS. 9 and 10, the impedance adjusting portion 540 is located forward of the assigned portion 560 in the X-direction. The thus-located impedance adjusting portion 540 is located over the exposed portions 712 of the signal cables 710. In particular, the impedance adjusting portion 540 according to the present embodiment is closer to the rear end 524 of the predetermined surface 520 than to the front end 522 of the predetermined surface 520 in the X-direction. In detail, the impedance adjusting portion 540 has a midpoint between the front end 542 and the rear end 544 in the X-direction which is located rearward of another midpoint between the front end 522 and the rear end 524 of the predetermined surface 520 in the X-direction. Therefore, the impedance adjusting portion 540 can be close to the boundary between the exposed portions 712 and the outer member 750 in the X-direction.

As shown in FIG. 10, the impedance adjusting portion 540 is located below both the predetermined surface 520 and the assigned portion 560. In other words, the impedance adjusting portion 540 is located inward of the connector body 30 in the perpendicular direction (Z-direction) perpendicular to both the X-direction and the Y-direction in comparison with both the predetermined surface 520 and the assigned portion 560. Therefore, when the connector body 30 is under the attached state where the front end 72 (see FIG. 4) of the cable 70 is attached thereto, the impedance adjusting portion 540 is closer to the exposed portions 712 of the signal cables 710 in the Z-direction than each of the predetermined surface 520 and the assigned portion 560 is.

According to the present embodiment, since the impedance adjusting portion 540 is provided so as to be close to the exposed portions 712 as described above, increase of the impedance due to the exposed portion 712 can be prevented. As a result, transmission efficiency of the signal cable 710 can be prevented from being degraded.

Referring to FIG. 11, the impedance adjusting portion 540 is located in a space where the outer member 750 of the cable 70 exists if not removed. Moreover, the impedance adjusting portion 540 extends between the vicinity of the positive Y-side end of the positive Y-side exposed portion 712 and the vicinity of the negative Y-side end of the negative Y-side exposed portion 712 in the Y-direction. This structure further effectively prevents the increase of the impedance due to the exposed portion 712.

Referring to FIG. 11, a size (width) W1 of the impedance adjusting portion 540 in the Y-direction is about two thirds of another size (width) W2 of the upper shell 50 in the Y-direction. Since the width W1 is narrower than the width W2, each of the side portions 570 protrudes inward in the Y-direction so that the side portion 570 is improved in its strength. However, from a view point of prevention of the increase of the impedance due to the exposed portion 712, the width W1 is preferred to be close to the width W2. More specifically, since the impedance adjusting portion 540 of the present embodiment is a part of the upper shell 50 (predetermined member), the width W1 of the impedance adjusting portion 540 is preferred to be equal to or more than two thirds of the width W2 of this predetermined member, or the upper shell 50, but equal to or less than the width W2.

The connector body 30 according to the present embodiment can be variously modified as described below in addition to the already described modifications.

Referring to FIG. 5, the shell 40 according to the present embodiment is formed of two members, namely the upper shell 50 and the lower shell 60. In particular, each of the predetermined surface 520, the impedance adjusting portion 540, the coupling portion 550 and the assigned portion 560 is formed as a part of the upper shell 50, and the crimp portion 660 is formed as a part of the lower shell 60.

However, the present invention is not limited thereto. For example, the upper shell 50 and the lower shell 60 may be integrally formed with each other. In other words, the shell 40 may be a single member which has the predetermined surface 520, the impedance adjusting portion 540, the coupling portion 550, the assigned portion 560 and the crimp portion 660. Instead, provided that the connector body 30 comprises these portions such as the impedance adjusting portion 540, the coupling portion 550 and the assigned portion 560, each of these portions may be a member separable from each of the upper shell 50 and the lower shell 60.

Referring to FIG. 11, the impedance adjusting portion 540 may be a part of a predetermined member other than the upper shell 50. In this case, the width W1 may be equal to or more than two thirds of a width of this predetermined member but equal to or less than the width of this predetermined member. Moreover, in a case where the shell 40 is a single member having the upper shell 50 and the lower shell 60 each of which is a part thereof, the width W1 may be equal to or more than two thirds of a width of this predetermined member, or the shell 40, but equal to or less than the width of this predetermined member.

Referring to FIG. 6, the predetermined surface 520 of the upper shell 50 is perpendicular to the Z-direction. However, the predetermined surface 520 may be oblique to the Z-direction to some extent. Thus, the predetermined surface 520 may intersect with the Z-direction. Moreover, the impedance adjusting portion 540 may have a shape other than the flat-plate shape. For example, the impedance adjusting portion 540 may have an arc shaped cross-section in the YZ-plane.

Figure 12:
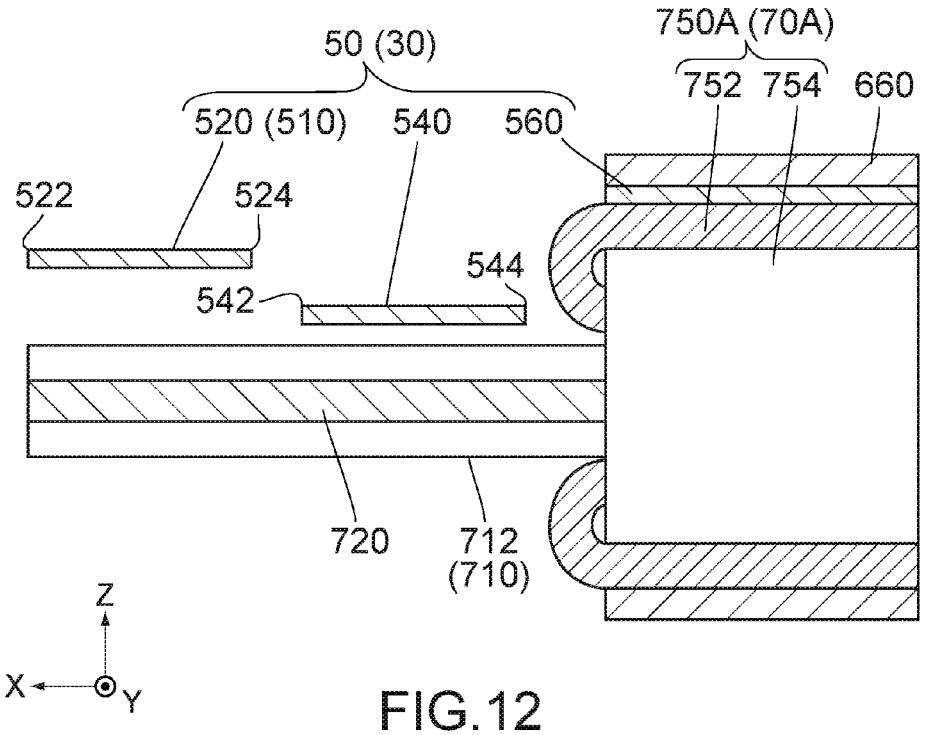
FIG. 12 is a schematic view showing a modification of the positional relation of FIG. 10.

Referring to FIG. 9, according to the present embodiment, under the attached state where the connector body 30 is attached to the front end 72 (see FIG. 4) of the cable 70, the crimp portion 660 is crimped on the outer member 750 of the cable 70, and the assigned portion 560 is located between the crimp portion 660 and the outer member 750. However, the present invention is not limited thereto. For example, referring to FIG. 12, the connector body 30 may be attached to a cable 70A which is slightly different from the cable 70 (see FIG. 4). The cable 70A comprises an outer member 750A instead of the outer member 750 (see FIG. 4). The outer member 750A comprises a shield 752 made of braided conductor and a jacket 754 made of insulator. Under the attached state, the shield 752 is partially folded back to be located between the assigned portion 560 and the jacket 754.

As shown in FIG. 10, the front end 542 of the impedance adjusting portion 540 according to the present embodiment is located between the front end 522 and the rear end 524 of the predetermined surface 520 in the X-direction. However, as can be seen from the modification shown in FIG. 12, the front end 542 of the impedance adjusting portion 540 may be located rearward of the rear end 524 of the predetermined surface 520 in the X-direction.

Referring to FIG. 1, the connector 20 of the wire harness 10 according to the present embodiment is a plug which is to be received in the mating connector 80. However, the present invention is not limited thereto. For example, referring to FIG. 13, a wire harness 10B according to a modification of the present embodiment comprises a connector 20B, which is a receptacle, and the cable 70.

Figure 13:
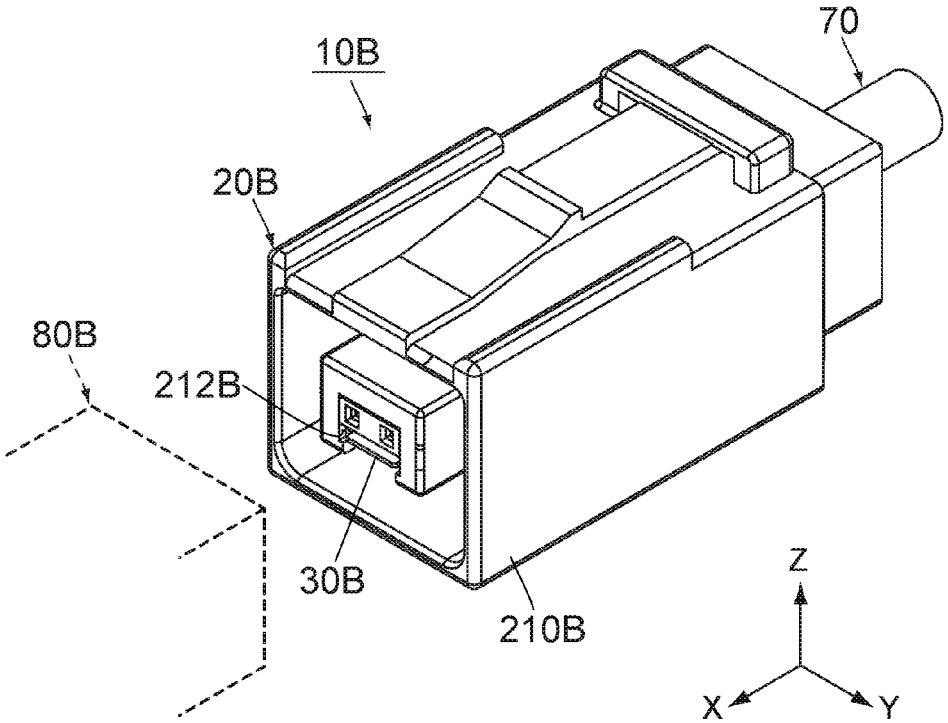
FIG. 13 is a perspective view showing a wire harness according to a modification of the present embodiment, wherein the wire harness comprises a cable and a connector mateable with a mating connector, a part of which is schematically illustrated by dashed line.
Figure 14:
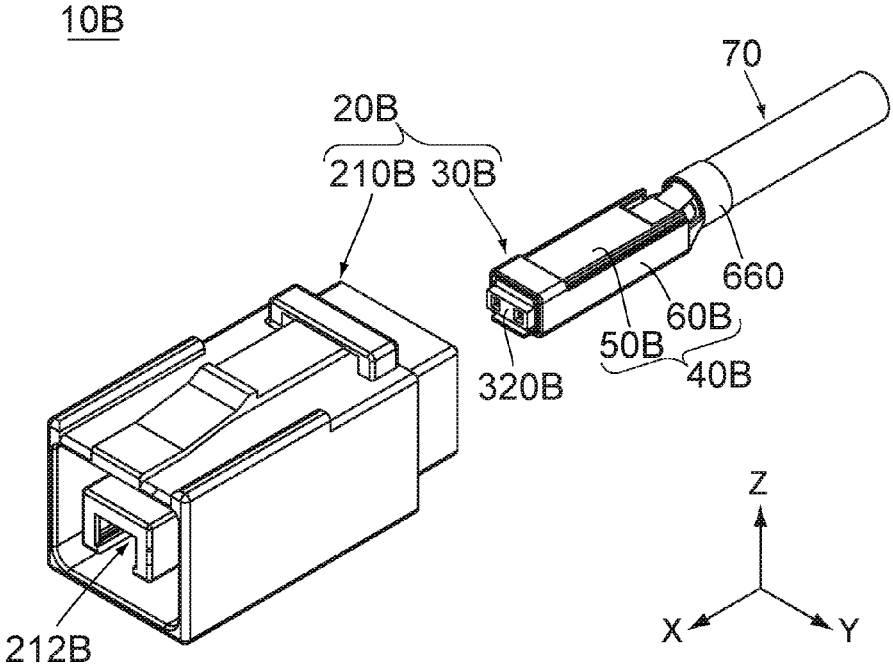
FIG. 14 is a perspective view showing the connector and the cable of FIG. 13, wherein the connector comprises an outer housing and a connector body which is attached to the cable but is not accommodated in the outer housing, and a joint of a crimp portion of a lower shell of the connector body is not illustrated.
Figure 15:
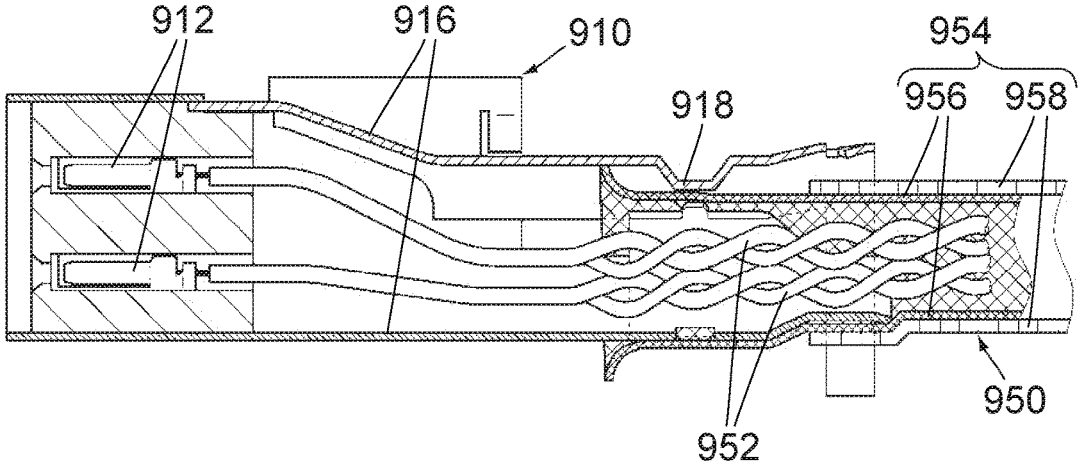
FIG.15 PRIOR ART
FIG. 15 is a cross-sectional view showing a connector and a cable of Patent Document 1.

Referring to FIGS. 13 and 14, the connector 20B comprises an outer housing 210B made of insulator and a connector body 30B. The outer housing 210B is formed with an accommodation portion 212B similar to the accommodation portion 212 (see FIG. 2). The connector body 30B is attached to the front end 72 (see FIG. 4) of the cable 70. The connector body 30B is inserted into and held by the accommodation portion 212B similar to the connector body 30 (see FIGS. 1 and 2). The connector 20B is mateable with a mating connector 80B, which is located forward thereof, along the X-direction similar to the connector 20 (see FIG. 1). However, the connector 20B receives the mating connector 80B under a mated state with the mating connector 80B.

Referring to FIG. 14, the connector body 30B comprises a holding member 320B made of insulator and a shell 40B instead of the holding member 320 and the shell 40 of the connector body 30 (see FIG. 2). The holding member 320B has a shape slightly different from that of the holding member 320 but works similar to the holding member 320. The shell 40B is formed of an upper shell 50B made of metal and a lower shell 60B made of metal. The upper shell 50B and the lower shell 60B have shapes which are slightly different from the upper shell 50 and the lower shell 60 (see FIG. 2), respectively, but work similar to the upper shell 50 and the lower shell 60, respectively.

The present invention is applicable not only to the aforementioned connectors but also to various connectors. For example, the present invention is also applicable to a water proof connector which has a water proof structure.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector attachable to a front end of a cable in a front-rear direction, the cable comprising coated signal cables and an outer member which protects the signal cables, and each of the signal cables having an exposed portion exposed outward of the outer member, wherein: the connector comprises comprising:

terminals;

a holding member;

a shell;

an assigned portion; and an impedance adjusting portion;

wherein:

the terminals are configured to be attached to the signal cables, respectively, when the connector is in an attached state in which the connector is attached to the front end of the cable;

the holding member holds the terminals;

the shell covers the holding member and has a predetermined surface which intersects with a perpendicular direction perpendicular to the front-rear direction;

the assigned portion is configured to be placed on the outer member of the cable when the connector is in the attached state;

the impedance adjusting portion is located forward of the assigned portion in the front-rear direction and located inward in the perpendicular direction in comparison with both the predetermined surface and the assigned portion such that the impedance adjusting portion is configured to shield the exposed portions in the perpendicular direction so as to prevent an increase of an impedance of the signal cables due to the exposed portions, when the connector is in the attached state;

the connector comprises a coupling portion;

the coupling portion couples the assigned portion and the impedance adjusting portion to each other; and the impedance adjusting portion is formed as a part of the shell.

2. The connector as recited in claim 1, wherein when the connector is in the attached state, the impedance adjusting portion is closer to the signal cables in the perpendicular direction than each of the predetermined surface and the assigned portion is.

3. The connector as recited in claim 1, wherein the impedance adjusting portion is, in the front-rear direction, closer to a rear end of the predetermined surface than to a front end of the predetermined surface.

4. The connector as recited in claim 1, wherein:

the terminals are arranged in a pitch direction perpendicular to the front-rear direction;

the impedance adjusting portion is a part of a predetermined member; and a size of the impedance adjusting portion in the pitch direction is equal to or more than two thirds of another size of the predetermined member in the pitch direction but equal to or less than the size of the predetermined member in the pitch direction.

5. The connector as recited in claim 1, wherein the impedance adjusting portion has a flat-plate shape.

6. The connector as recited in claim 1, wherein:

the shell has a crimp portion; and the crimp portion is configured to be crimped on the outer member of the cable, and the assigned portion is configured to be located between the crimp portion and the outer member, when the connector is in the attached state.

7. The connector as recited in claim 1, wherein:

the outer member of the cable comprises a jacket and a shield; and in the attached state, the shield is partially located between the assigned portion and the jacket.

8. A wire harness comprising:

a connector; and a cable;

wherein:

the connector is attached to a front end of the cable in a front-rear direction;

the cable comprises coated signal cables and an outer member;

each of the signal cables has a protected portion and an exposed portion;

the outer member protects the protected portions of the signal cables;

the exposed portion is located forward of the protected portion and exposed outward of the outer member;

the connector comprises terminals, a holding member, a shell, an assigned portion, and an impedance adjusting portion;

the terminals are attached to the exposed portions of the signal cables, respectively;

the holding member holds the terminals;

the shell covers the holding member and has a predetermined surface which intersects with a perpendicular direction perpendicular to the front-rear direction;

the assigned portion is placed on the outer member of the cable;

the impedance adjusting portion is located forward of the assigned portion in the front-rear direction and is closer to the exposed portions of the signal cables in the perpendicular direction than each of the predetermined surface and the assigned portion is;

the impedance adjusting portion shields the exposed portions in the perpendicular direction so as to prevent an increase of an impedance of the signal cables due to the exposed portions;

the connector comprises a coupling portion;

the coupling portion couples the assigned portion and the impedance adjusting portion to each other; and the impedance adjusting portion is formed as a part of the shell.

9. A wire harness comprising:

a connector; and a cable;

wherein:

the connector is attached to a front end of the cable in a front-rear direction;

the cable comprises coated signal cables and an outer member;

each of the signal cables has a protected portion and an exposed portion;

the outer member protects the protected portions of the signal cables;

the exposed portion is located forward of the protected portion and exposed outward of the outer member;

the connector comprises terminals, a holding member, a shell, and an impedance adjusting portion;

the terminals are attached to the exposed portions of the signal cables, respectively;

the holding member holds the terminals;

the shell covers the holding member and has a predetermined surface which intersects with a perpendicular direction perpendicular to the front-rear direction;

the impedance adjusting portion is closer to the exposed portions of the signal cables in the perpendicular direction than the predetermined surface is;

the impedance adjusting portion shields the exposed portions in the perpendicular direction so as to prevent an increase of an impedance of the signal cables due to the exposed portions; and the impedance adjusting portion is formed as a part of the shell.

* * * * *